US011108194B2

(12) United States Patent
Lin et al.

(10) Patent No.: US 11,108,194 B2
(45) Date of Patent: Aug. 31, 2021

(54) ELECTRICAL CONNECTOR INCLUDING SHIELDING NET CONNECTED TO CONDUCTIVE BODY

(71) Applicant: Topconn Electronic (Kunshan) Co., Ltd, Kunshan (CN)

(72) Inventors: Sanyo Lin, Kunshan (CN); Fu Su, Kunshan (CN); Maoshan Chen, Kunshan (CN); Kai Wu, Kunshan (CN)

(73) Assignee: STARCONN ELECTRONIC (Su Zhou) Co., LTD, Kunshan (CN)

( * ) Notice: Subject to any disclaimer, the term of this patent is extended or adjusted under 35 U.S.C. 154(b) by 0 days.

(21) Appl. No.: 16/819,204

(22) Filed: Mar. 16, 2020

(65) Prior Publication Data

US 2020/0381868 A1 Dec. 3, 2020

(30) Foreign Application Priority Data

May 31, 2019 (CN) ..... 201920815386.X

(51) Int. Cl.
*H01R 13/6471* (2011.01)

(52) U.S. Cl.
CPC ..... *H01R 13/6471* (2013.01)

(58) Field of Classification Search
CPC ..... H01R 13/6585; H01R 13/6591; H01R 13/6597; H01R 13/6471; H01R 13/6461
USPC ..... 439/607.12, 607.13, 607.55, 607.53, 439/607.34, 607.09, 607.07, 95
See application file for complete search history.

(56) References Cited

U.S. PATENT DOCUMENTS 6,899,566 B2 * 5/2005 Kline ..... H01R 13/6587 439/607.56
7,544,096 B2 * 6/2009 Cohen ..... H01R 13/6474 439/607.05
8,002,581 B1 * 8/2011 Whiteman, Jr. ..... H01R 12/724 439/607.18
8,398,432 B1 * 3/2013 McClellan ..... H01R 13/6471 439/607.07
8,398,434 B2 * 3/2013 Davis ..... H01R 12/727 439/607.34
8,419,472 B1 * 4/2013 Swanger ..... H01R 13/6587 439/607.07
8,444,435 B2 * 5/2013 Lee ..... H01R 13/6587 439/607.07

(Continued)

*Primary Examiner* — Abdullah A Riyami
*Assistant Examiner* — Marcus E Harcum
(74) *Attorney, Agent, or Firm* — Gang Yu

(57) ABSTRACT

The application provides an electrical connector, which includes: an insulating body, including a first surface and a second surface opposite to the first surface; a plurality of grounding terminals and a plurality of signal terminals, the plurality of grounding terminals and the plurality of signal terminals being connected to the insulating body in an array; a conductive body, connected to the insulating body from the first surface; and a conductive shielding net. The shielding net is connected to the insulating body from the second surface and electrically connected to the conductive body, and the plurality of grounding terminals are electrically connected with the shielding net through the conductive body. According to the electrical connector of the application, by the shielding net, shielding in an insertion direction may be implemented better, thereby preventing or reducing crosstalk generated during a signal transmission of the electrical connector.

14 Claims, 15 Drawing Sheets

(56) References Cited

U.S. PATENT DOCUMENTS 8,465,323 B2 * 6/2013 Jeon ..... H01R 13/6582 439/607.07
8,662,924 B2 * 3/2014 Davis ..... H01R 13/6477 439/607.07
8,888,530 B2 * 11/2014 Trout ..... H01R 13/6587 439/607.07
8,888,531 B2 * 11/2014 Jeon ..... H01R 13/6594 439/607.07
8,905,786 B2 * 12/2014 Davis ..... H01R 13/6587 439/607.1
9,666,961 B2 * 5/2017 Horning ..... H01R 12/7076
10,128,619 B2 * 11/2018 Morgan ..... H01R 13/6587
10,135,199 B1 * 11/2018 Ju ..... H01R 12/714
10,188,811 B2 * 1/2019 Zeng ..... A61P 29/00
10,476,210 B1 * 11/2019 Trout ..... H01R 13/6587
10,790,618 B2 * 9/2020 Munoz ..... H01R 12/73
2010/0022130 A1 * 1/2010 Barr ..... H01R 13/6471 439/607.09
2013/0017726 A1 * 1/2013 Davis ..... H01R 13/6586 439/607.55
2013/0052843 A1 * 2/2013 Johnescu ..... H01R 13/6471 439/95
2013/0102192 A1 * 4/2013 Davis ..... H01R 12/00 439/607.07
2015/0011122 A1 * 1/2015 Chang ..... H01R 13/6588 439/607.09
2015/0056857 A1 * 2/2015 Chang ..... H01R 12/51 439/607.09
2015/0171574 A1 * 6/2015 Little ..... H01R 24/60 439/78
2016/0072231 A1 * 3/2016 Sypolt ..... H01R 13/6597 439/607.08
2016/0087378 A1 * 3/2016 Chen ..... H01R 13/6597 439/607.34
2019/0058292 A1 * 2/2019 Xu ..... H01R 13/6597
2019/0058293 A1 * 2/2019 Zhu ..... H01R 13/504
2019/0131748 A1 * 5/2019 Cheng ..... H01R 13/6597
2019/0229481 A1 * 7/2019 Zhao ..... H01R 13/6585
2020/0076131 A1 * 3/2020 Hu ..... H01R 13/405
2020/0076135 A1 * 3/2020 Tang ..... H01R 12/724

* cited by examiner

ELECTRICAL CONNECTOR INCLUDING SHIELDING NET CONNECTED TO CONDUCTIVE BODY

CROSS-REFERENCE TO RELATED APPLICATION

This application claims priority to and the benefit of Chinese Patent Application No. 201920815386X, filed on May 31, 2019, the entire contents of which are incorporated herein by reference.

TECHNICAL FIELD

The application relates to an electrical connector, and more particularly to an electrical connector for signal transmission, which may prevent or reduce crosstalk generated during a signal transmission of the electrical connector.

BACKGROUND

In an electronic or communication system, circuits and electronic modules are usually arranged on some separated printed circuit boards, and these separated printed circuit boards are connected to each other by electrical connectors. An electrical connector implements connection of a backplane and each daughterboard. Along with constantly increase of bandwidth requirements from users, more and more circuits have been arranged in a specified narrow region of each printed circuit board and work at increasing frequencies. Correspondingly, an electrical connector between printed circuit boards transmits data at an increasing rate, and a signal transmission rate has reached 6 Gbps and even 10 Gbps or higher. Such a high-speed and high-density connection requires a high requirement on a signal integrity (SI) performance index, particularly a numerical value of a crosstalk index, of the electrical connector.

In order to preventing such crosstalk, efforts have been made to a certain extent in prior arts. For example, an electrical connector is provided in Patent Application No. CN205863449U, the electrical connector includes a conductive plastic for connecting grounding terminals, and a plurality of linearly arranged rectangular blocks are arranged between adjacent terminal rows to form shields between two differential signal terminal pairs adjacent to the rectangular blocks. However, since the conductive plastic is formed integrally with a U-shaped plastic body by a secondary injection molding manner, and due to differences between material characteristics, a preparation process is complex and unfavorable for mass production. In a preparation and forming process of the conductive plastic, extension of the linear rectangular block in a length direction may not be excessively increased for enhancement of a shielding effect under the limit of spaces of a mold and the U-shaped plastic body, and this is because excessive extension of the rectangular block in the length direction may cause a corresponding rectangular groove in the corresponding U-shaped plastic body excessively long, thereby reduce structural stability of the U-shaped plastic body.

In addition, an electrical connector is provided in No. CN202930673U, the electrical connector includes a double-layer shielding structure for shielding a signal terminal in an insertion direction. However, the metal shielding structure is directly connected with a grounding terminal by a spring finger, and such direct physical connection between metal components may cause metal debris, thereby bringing negative interference influence to the whole mechanism.

In view of this, the application discloses an electrical connector, to overcome the shortcomings.

SUMMARY

The application is intended to provide an electrical connector, which may prevent or reduce crosstalk generated during a signal transmission of the electrical connector.

The application provides an electrical connector, which includes: an insulating body, comprising a first surface and a second surface opposite to the first surface; a plurality of grounding terminals and a plurality of signal terminals connected to the insulating body in an array respectively; a conductive body, connected to the insulating body from the first surface; and a shielding net. The shielding net is connected to the insulating body from the second surface and electrically connected to the conductive body, and the plurality of grounding terminals are electrically connected with the shielding net through the conductive body. By the shielding net, the electrical connector may be shielded from a insertion direction, thereby preventing or reducing crosstalk generated during a signal transmission of the electrical connector.

Further, at least one row of the plurality of grounding terminals in a row direction is electrically connected with the shielding net through the conductive body. Further, at least one column of the plurality of grounding terminals in a column direction is electrically connected with the shielding net through the conductive body. Therefore, the grounding terminals are common ground together in the row and/or column directions for grounding the shielding net better, thereby ensure a shielding effect.

Further, the shielding net comprises a plurality of terminal opening rows, each terminal opening row comprises a plurality of grounding terminal openings for the grounding terminals of the electrical connector to pass through and a plurality of signal terminal openings for the signal terminals to pass through, the signal terminal openings are configured to space the signal terminals from the shielding net, and in any terminal opening row, the grounding terminal openings and signal terminal openings are alternately arranged and spaced from one another in the row direction. The shielding net distinguishes different openings, thereby effectively enlarging a shielding area.

Further, at least one grounding terminal opening in any terminal opening row and the corresponding grounding terminal opening in another adjacent terminal opening row are staggered in the column direction, and projections of at least one signal terminal opening in any terminal opening row and the corresponding signal terminal opening in another adjacent terminal opening row in the column direction are at least partially overlapped. By such staggered arrangement, the signal terminals may be isolated better and be arranged more close for increasing the density, thereby performance of the electrical connector may be improved.

Further, one or more connecting tabs formed by downward bending are arranged at two ends of the shielding net in an extension direction of the terminal opening row respectively. By the connecting tabs, the shielding net may be firmly fixed to the insulating body of the electrical connector.

Further, a plurality of L-shaped protrusions are arranged on the conductive body. A short edge portion of the L-shaped protrusion extends along the column direction of the array and is electrically connected to the corresponding grounding terminal, a long edge portion of the L-shaped protrusion extends along the row direction of the array, and the shielding net directly contacts with a top of the L-shaped protrusion in an insertion direction. Further, the L-shaped protrusions are arranged in notches of the insulating body respectively, and a row of the L-shaped protrusions are formed between every two adjacent terminal rows. Thus, the differential terminal pairs may be shielded well to avoid crosstalk interference by the arrangement of the L-shaped protrusions. Meanwhile, the shielding net is electrical connected with the grounding terminals through the L-shaped protrusions, thereby the differential signal terminal pairs be shielded well in six directions.

Further, a protruding portion is formed on the second surface of the insulating body for fitting with the shielding net.

Further, the shielding net comprises a plurality of signal terminal openings for the signal terminals to pass through, each of the signal terminal openings fits with the protruding portion.

Further, the shielding net is arranged on the second surface of the insulating body and forms a substantially flat surface with the protruding portion.

Further, the insulating body comprises a plurality of first terminal openings for the grounding terminals to pass through and a plurality of second terminal openings for the signal terminals to pass through. The protruding portion is formed at a portion surrounding the second terminal opening. After mounting, the shielding net is arranged on the second surface of the insulating body, and the shielding net is ensured to be electrically connected with the L-shaped protrusions well, and meanwhile, forms a relatively flat surface structure with the protruding portions on the second surface.

Further, every two adjacent signal terminals in the row direction of the array form a differential signal terminal pair, and each differential signal terminal pair passes through the corresponding signal terminal opening and is at a distance from the signal terminal opening. By the distance between the signal terminal opening and the differential signal terminal pair, the short-circuit may be effectively prevented.

Further, the shielding net is a metal shielding net.

Further, the shielding net is a conductive plastic shielding net.

BRIEF DESCRIPTION OF THE DRAWINGS

The drawings in the description are adopted to provide a further understanding to the application and constitude a part of the application. Schematic embodiments of the application and description thereof are adopted to explain the application and not intended to constitude improper limitation to the application, wherein.

DETAILED DESCRIPTION OF THE EMBODIMENTS

Figure 1:
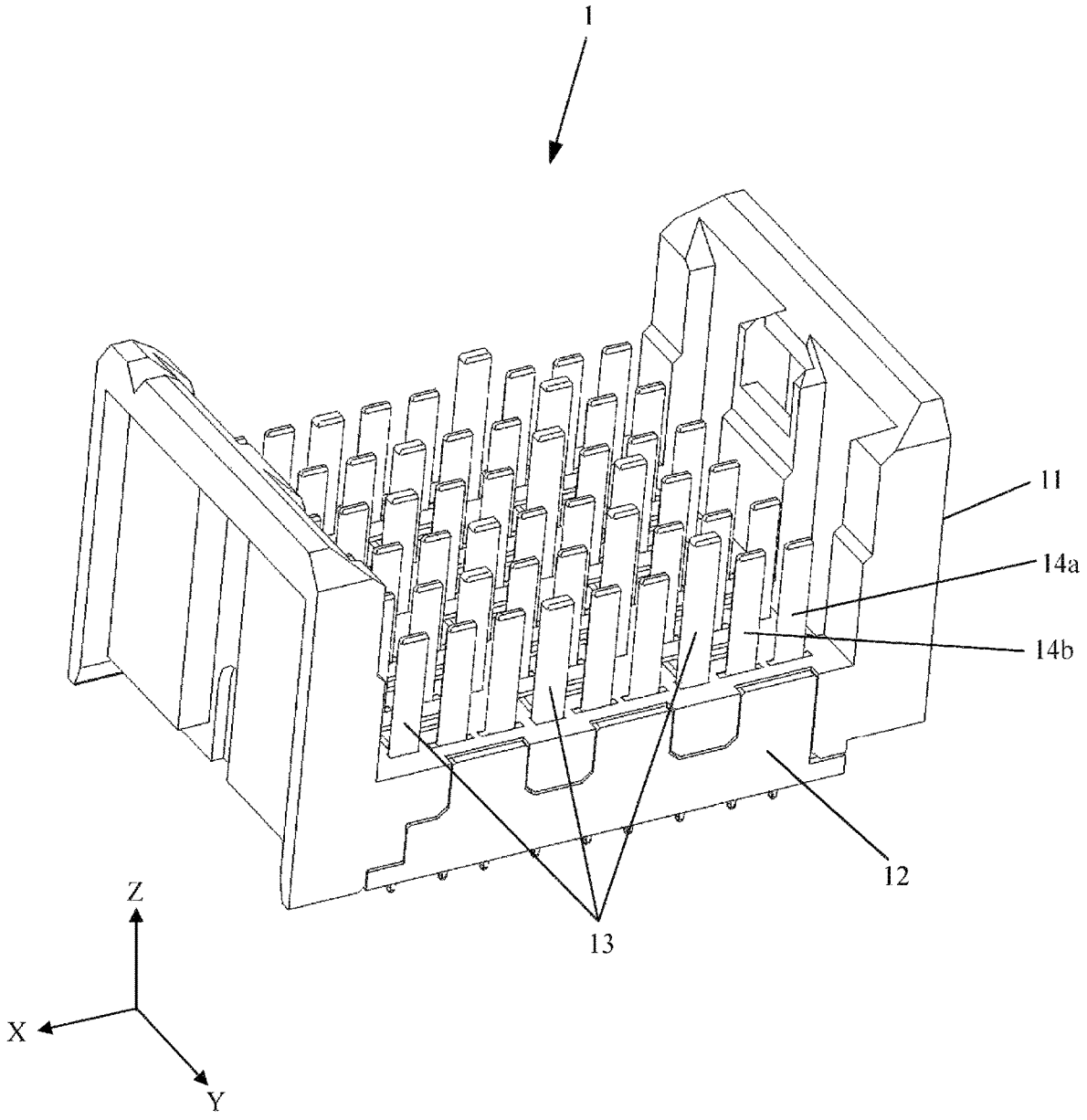
FIG. 1 is a perspective view of an electrical connector according to a first embodiment of the disclosure.

The technical solutions in the embodiments of the application will be described below in combination with the drawings in the embodiments of the application in detail. It is to be noted that the embodiments in the application and characteristics thereof may be combined without conflicts.

As shown in FIG. 1 to FIG. 4, an electrical connector 1 according to a first embodiment of the application generally includes an insulating body 11, a conductive body 12, a plurality of grounding terminals 13 and a plurality of signal terminals. The conductive body 12 is located relative to the insulating body 11, wherein the conductive body 12 is an individual component that is integrally formed and assembled and matched with the insulating body 11. Convenience for a preparation in manufacture, easiness for mass production and high replaceability are ensured. The plurality of grounding terminals 13 and the plurality of signal terminals are connected to the insulating body 11 in an array. Every two adjacent signal terminals in a row direction X of the array form a differential signal terminal pair 14, and the differential signal terminal pairs 14 (including a first signal terminal 14*a* and a second signal terminal 14*b*) and the grounding terminals 13 are alternately arranged in the row direction X to form terminal rows. In an unlimited example shown in FIG. 1, the array includes six terminal rows and nine terminal columns, each terminal row includes three differential signal terminal pairs 14, and three grounding terminals 13 are alternately arranged between the differential terminal pairs 14. Moreover, projections of the differential signal terminal pairs 14 in adjacent terminal rows in a column direction Y perpendicular to the row direction X are at least partially overlapped. But the present disclosure does not limited thereto, in other embodiment, two differential signal terminal pairs 14 may arranged two grounding terminals 13 therebetween.

Figure 2A:
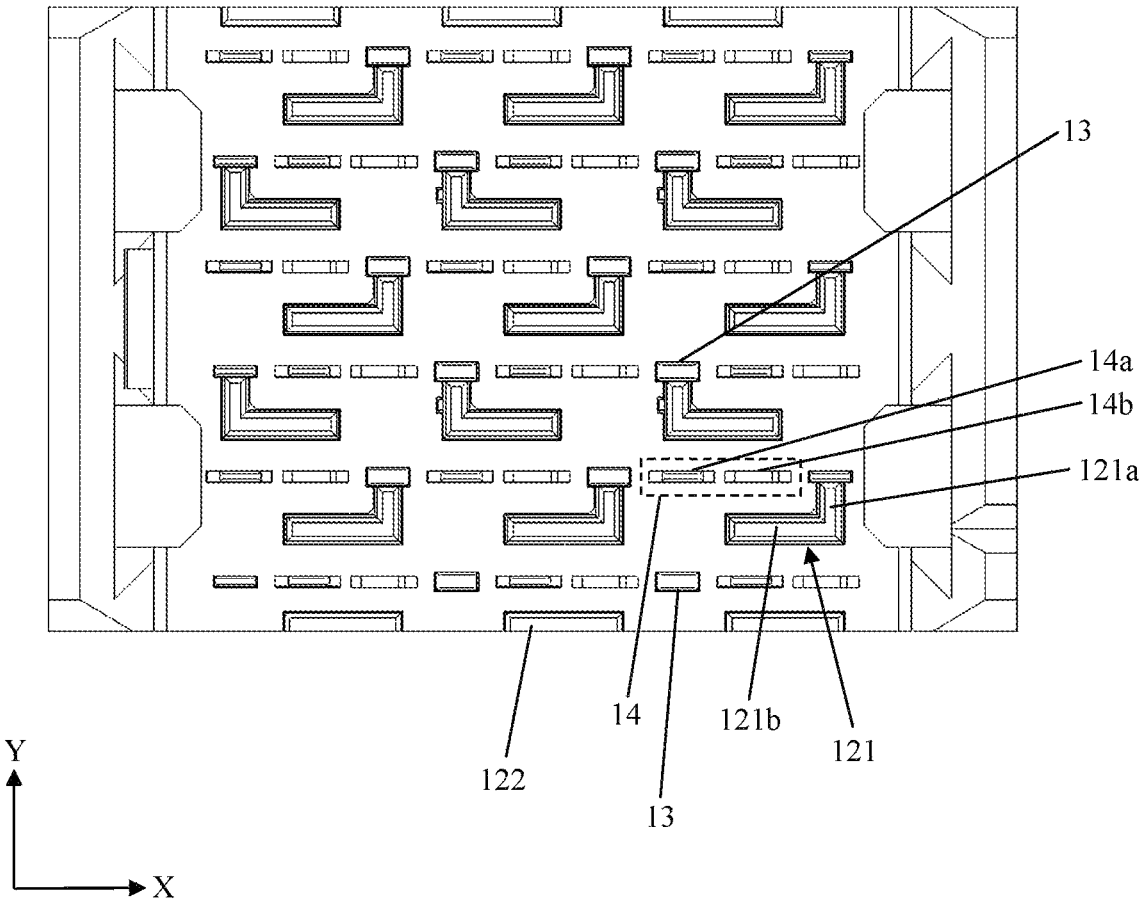
FIG. 2*a* is a top view of the electrical connector according to the first embodiment of the disclosure.
Figure 7:
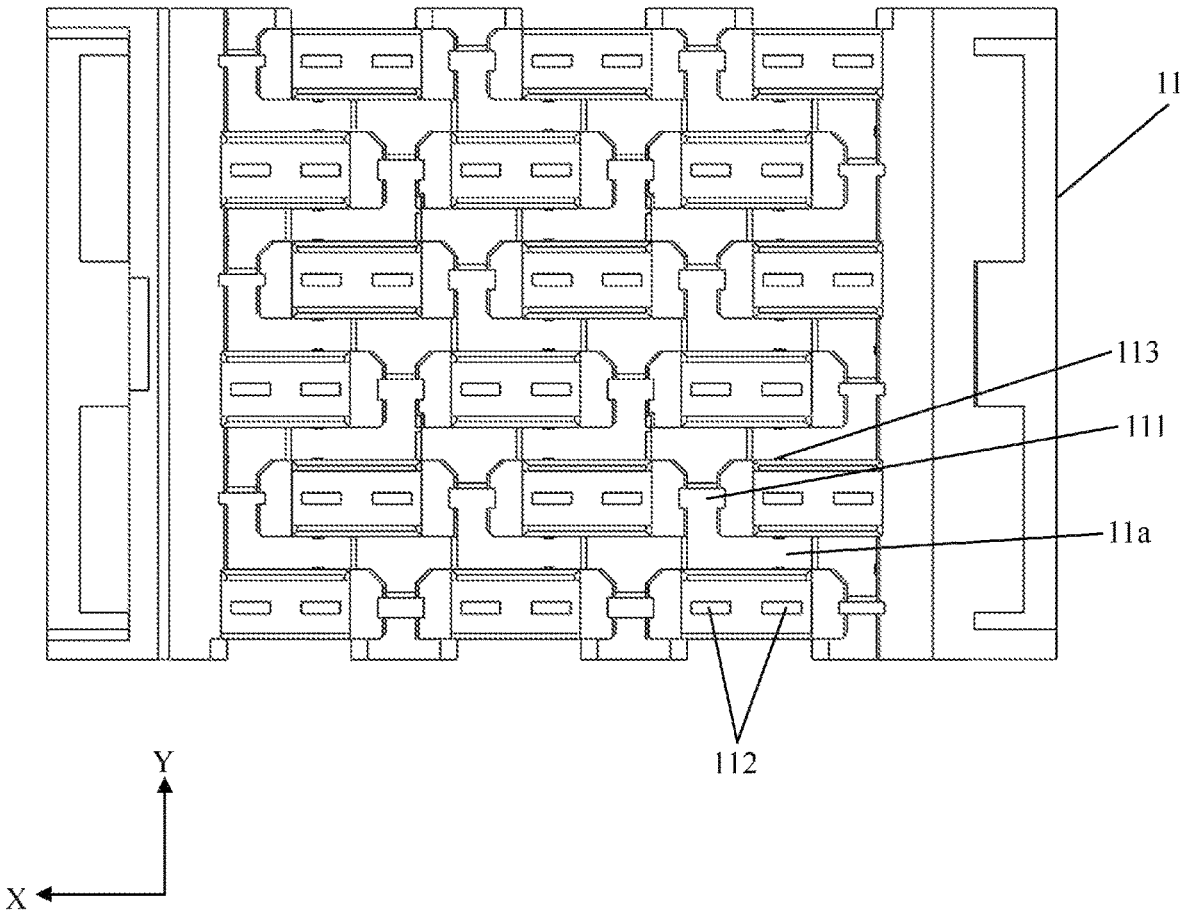
FIG. 7 is a bottom view of an insulating body of the electrical connector according to the first embodiment of the disclosure.

As shown in FIG. 2*a*, a plurality of L-shaped protrusions 121 are arranged on the conductive body 12, the L-shaped protrusions 121 are arranged in notches 11*a* of the insulating body 11 (as shown in FIG. 7) respectively, and every two adjacent terminal rows formed a row of the L-shaped protrusions therebetween. The L-shaped protrusion 121 includes a short edge portion 121*a* and a long edge portion 121*b*, a first end of the short edge portion 121*a* is connected with a first end of the long edge portion 121*b*, the short edge portion 121*a* preferably forms a right-angle connection with the long edge portion 121*b*, the short edge portion 121*a* extends along the column direction Y and is electrically connected to the corresponding grounding terminal 13 by a second end of the short edge portion 121*a*, and the long edge portion 121*b* extends along the row direction X to isolate a part of the differential signal terminal pairs 14 in adjacent terminal rows that are at least partially overlapped in the column direction Y. Preferably, one signal terminal of the differential signal terminal pair 14 is isolated.

By such a specific arrangement for the L-shaped protrusions 121 of the electrical connector, the long edge portion 121*b* extending along the row direction X is intended to isolate the part of the differential signal terminal pairs 14 in the adjacent terminal rows that are at least partially overlapped in the column direction Y, there are enough distances between the notches 11*a* in the insulating body 11 in the row direction X, thereby strength and structural stability of the insulating body 11 may be ensured. In addition, the L-shaped protrusions 121 of the conductive body 12 may also shield adjacent differential signal terminal pairs 14 in the column direction Y to avoid crosstalk interference.

As shown in FIG. 2*a*, the differential signal terminal pairs 14 in adjacent terminal rows are staggered so that the first signal terminal 14*a* in the differential signal terminal pair 14 in one terminal row and a grounding terminal 13 in the adjacent terminal row are arranged relative to each other, and the second signal terminal 14*b* in the differential signal terminal pair 14 in the terminal row and the first signal terminal 14*a* in the differential signal terminal pair 14 in the adjacent terminal row are arranged relative to each other, thereby the relatively arranged terminals along the column direction Y form signal terminal columns. That is, as shown in FIG. 2*a*, if the leftmost signal terminal column is a first signal terminal column and the rightmost signal terminal column is a ninth signal terminal column, the first signal terminals 14*a* and the grounding terminals are alternately arranged along the column direction Y in the first signal terminal column, and the second signal terminals 14*b* and the first signal terminals 14*a* are alternately arranged along the column direction Y in a second signal terminal column.

The terminals in adjacent terminal rows are staggered, so that crosstalk interference generated during a high-frequency signal transmission may further be reduced or avoided, adaptation to a chip and a circuit board may be implemented better, and slots or openings in the insulating body may be scattered as much as possible to reduce structural weak links so that an overall structure of the electrical connector becomes more stable.

As shown in FIG. 2*a*, the long edge portions 121*b* of the L-shaped protrusions 121 may respectively extend through a region between the adjacent signal terminals in the signal terminal columns along the row direction X. That is, the long edge portions 121*b* of the L-shaped protrusions 121 are configured to respectively extend to a region between the second signal terminals 14*b* and first signal terminals 14*a* in the signal terminal columns where the second signal terminals 14*b* and the first signal terminals 14*a* are alternately arranged along the column direction Y.

By such arrangement, in the row direction X, adjacent differential signal terminal pairs 14 in the terminal rows are spaced and shielded by the grounding terminals 13; and in the column direction Y, one side of the first signal terminal 14*a* in each differential signal terminal pair 14 is shielded by the grounding terminal 13, while the other side is shielded by the grounding terminal 13 and the L-shaped protrusion 121, and both sides of the second signal terminals 14*b* in the differential signal terminal pair 14 are shielded by the long edge portions 121*b* of the L-shaped protrusions 121. As such, any two adjacent signal terminal pairs 14 may be shielded, thereby the crosstalk generated during a signal transmission of the electrical connector may be prevented or reduced.

Preferably, a second end of the long edge portion 121*b* of the L-shaped protrusion 121 may extend to a position flushed with the signal terminal in the corresponding signal terminal column in the column direction Y. That is, as shown in FIG. 2*a*, the long edge portion 121*b* of the L-shaped protrusion 121 may extend in the region between the second signal terminal 14*b* (on one side) and the first signal terminal 14*a* (on the other side) of the same signal terminal column. An edge of the long edge portion is flushed with edges of the second signal terminal 14*b* and the first signal terminal 14*a* along the column direction Y (namely flushed with an imaginary flush line extending along the column direction Y).

By such a "flush" arrangement for the long edge portions 121*b* of the L-shaped protrusions 121, the differential signal terminal pairs 14 may be shielded well, meanwhile the notch 11*a* of the insulating body 11 for arranging the L-shaped protrusion 121 therein is not too large, for ensuring structural strength of the insulating body 11.

From FIG. 2*a*, it can also be seen that, in the embodiment, the long edge portion 121*b* of the L-shaped protrusion 121 may equidistant from two adjacent terminal rows respectively. As such, the long edge portion 121*b* of the L-shaped protrusion 121 is arranged at a middle position between the adjacent terminal rows, so that the conductive body 12 and the insulating body 11 are structurally arranged more uniformly and stably. In addition, an extension height of the L-shaped protrusion 121 in an insertion direction Z perpendicular to both the row direction X and the column direction Y may be configured to be consistent with a depth of the notch 11*a*. Therefore, the shielding of the signal terminal pairs 14 by the L-shaped protrusions 121 in the insulating body 11 may be ensured, and influence on connection and shielding between each of the grounding terminals 13 and signal terminal pairs 14 on the electrical connector and other connected components may be eliminated.

As shown in FIG. 2*a*, extension directions of the long edge portions 121*b* of two adjacent rows of the L-shaped protrusions 121 relative to the short edge portions 121*a* are opposite. In FIG. 2*a*, the long edge portions 121*b* of the bottom row of the L-shaped protrusions 121 each extend leftwards relative to the short edge portions 121*a*, and the long edge portions 121*b* of the L-shaped protrusions in the adjacent row above each extend rightwards relative to the short edge portions 121*a*.

The short edge portions 121*a* of two adjacent L-shaped protrusions 121 in the column direction Y may extend along the same direction, and the long edge portions 121*b* of two adjacent L-shaped protrusions 121 in the column direction Y may extend along the opposite direction.

The short edge portions 121*a* of two adjacent L-shaped protrusions 121 in the row direction X may extend along the same direction, and the long edge portions 121*b* of two adjacent L-shaped protrusions 121 in the row direction X may extend along the same direction.

By such an arrangement, a good shielding effect may be achieved, and the structural strength of the insulating body 11 may favorably be ensured.

Figure 2B:
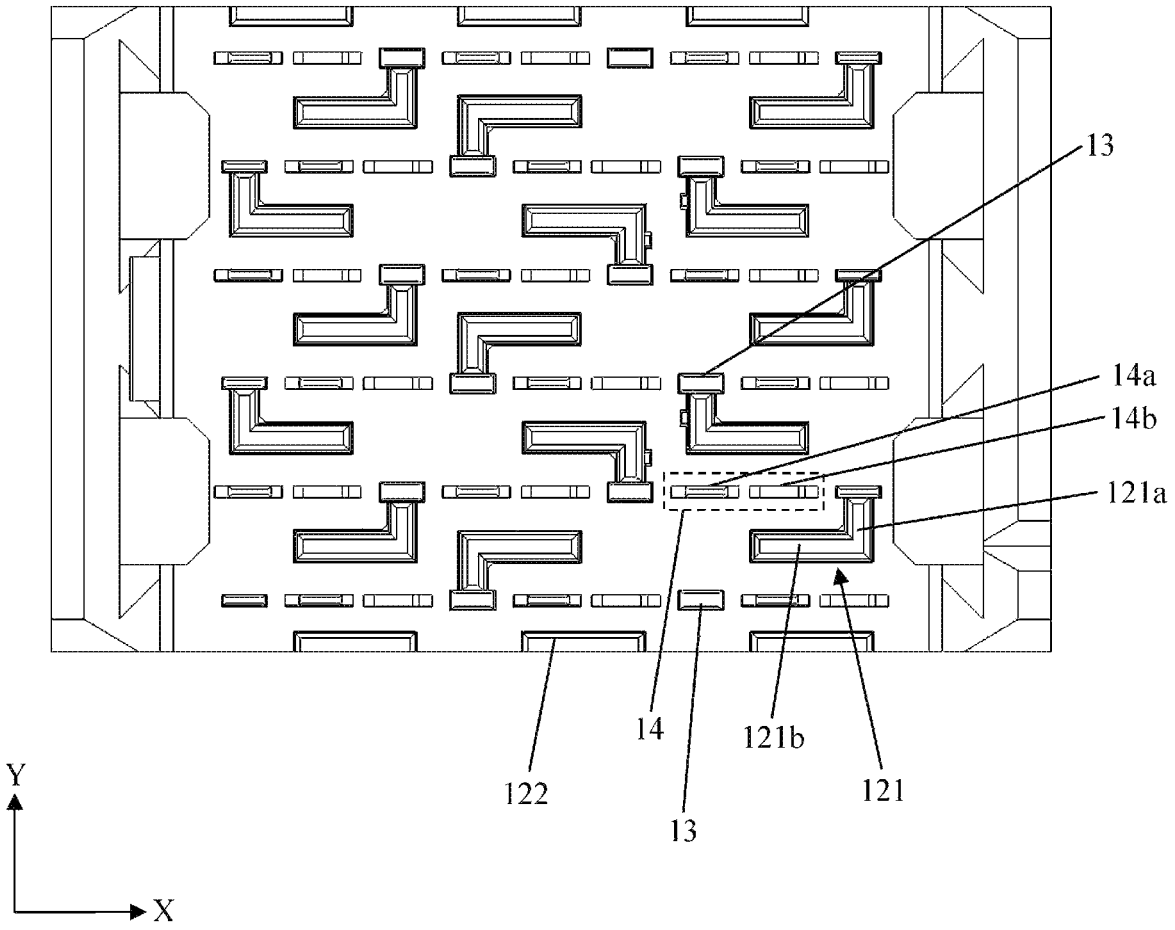
FIG. 2*b* is a top view of the electrical connector according to the first embodiment of the disclosure, showing another arrangement for L-shaped protrusions.

FIG. 2*b* illustrates another arrangement for the L-shaped protrusions 121. The difference between the L-shaped protrusions 121 shown in FIG. 2*a* and that shown in FIG. 2*b* is that the short edge portions 121*a* of two adjacent L-shaped protrusions 121 in the row direction X extend along the opposite direction and the long edge portions 121*b* of two adjacent L-shaped protrusions 121 in the row direction X extend along the opposite direction. By such an arrangement, a good shielding effect may also be achieved.

Figure 3:
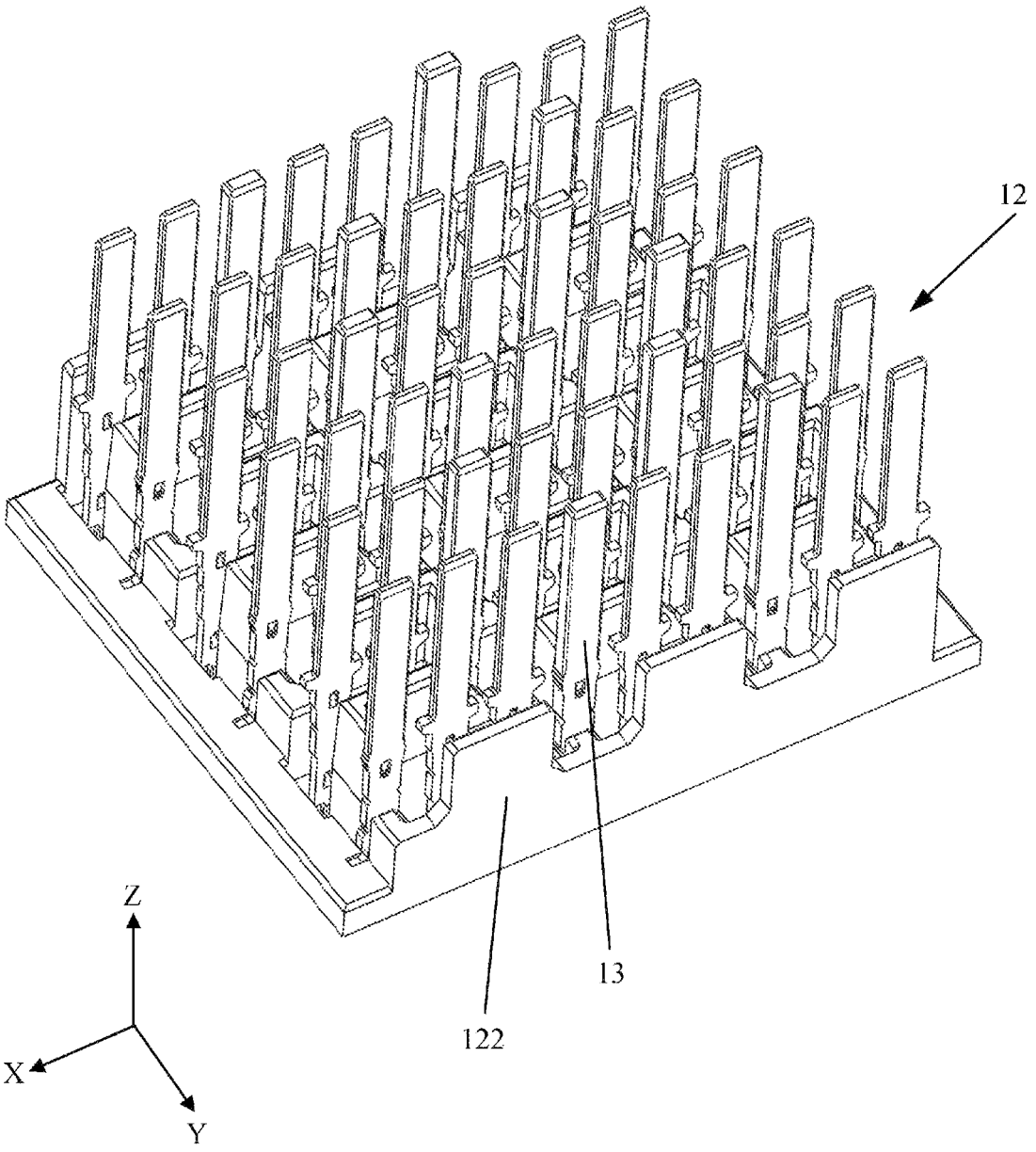
FIG. 3 is a perspective view of a conductive body of the electrical connector according to the first embodiment of the disclosure, wherein grounding terminals have been connected to the conductive body.
Figure 4:
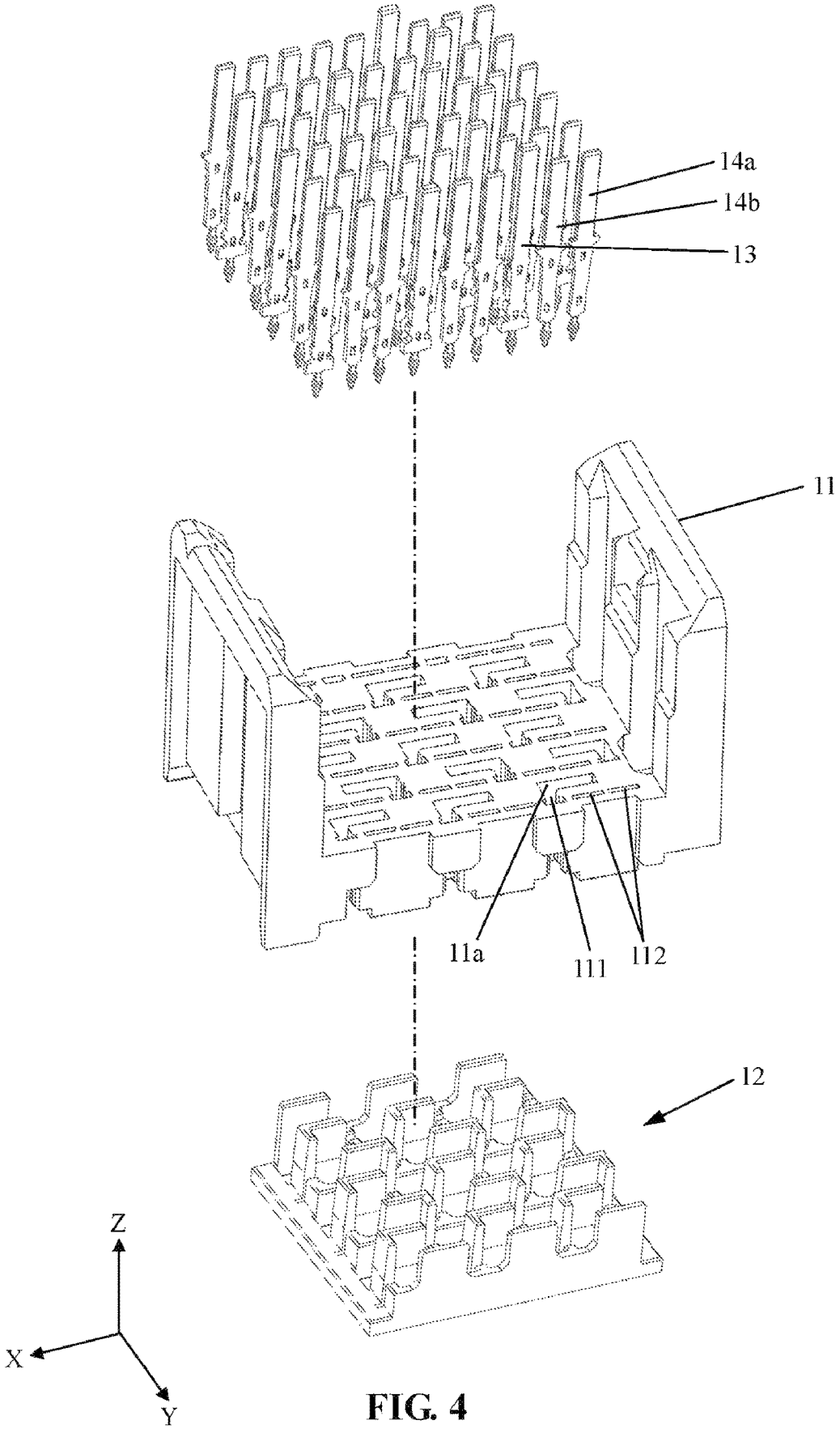
FIG. 4 is an explored view of the electrical connector in FIG. 1.

As shown in FIG. 2*a* and FIG. 3, conductive protruding blocks 122 extending upwards are arranged on two opposite edges of the conductive body 12 in the column direction Y respectively, and an extension distance of the conductive protruding block 122 in the row direction X is equal to a distance from the first end to second end of the long edge portion 121*b* of the L-shaped protrusion 121, so that the differential signal terminal pairs 14 in the corresponding rows are shielded to avoid interference with other circuit structure/chip on the circuit board. Meanwhile, the conductive protruding blocks 122 may also provide a constructive interference when the conductive body 12 is connected with the insulating body 11 (for example, the conductive protruding blocks 122 on the conductive body 12 may form interference fit with the corresponding matched notches in the insulating body 11) to reduce or avoid the risk of separation of the conductive body 12 from the insulating body 11.

Figure 8A:
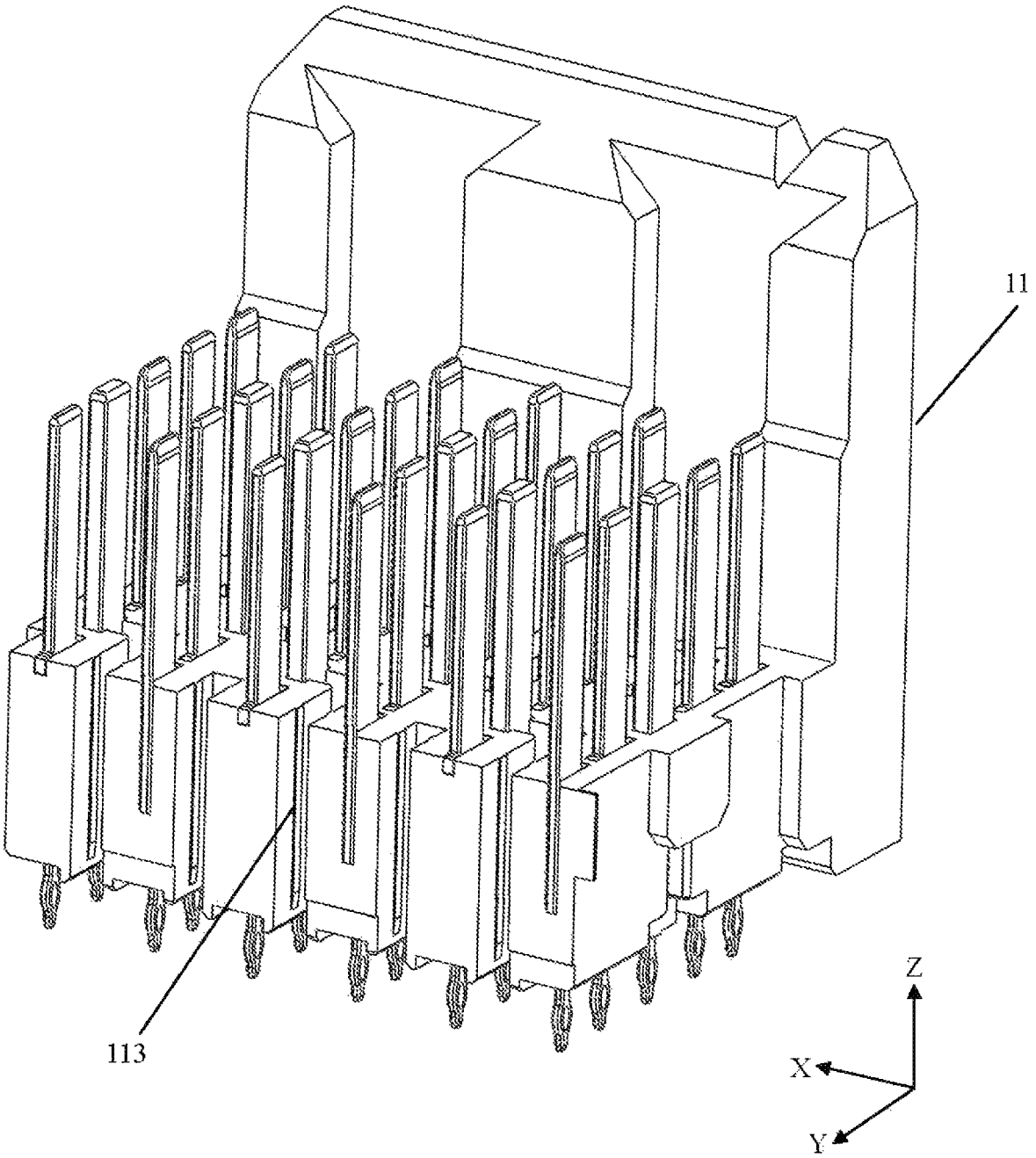
FIG. 8*a* and FIG. 8*b* are partial sectional perspective views of the insulating body of an electrical connector according to the disclosure.
Figure 8B:
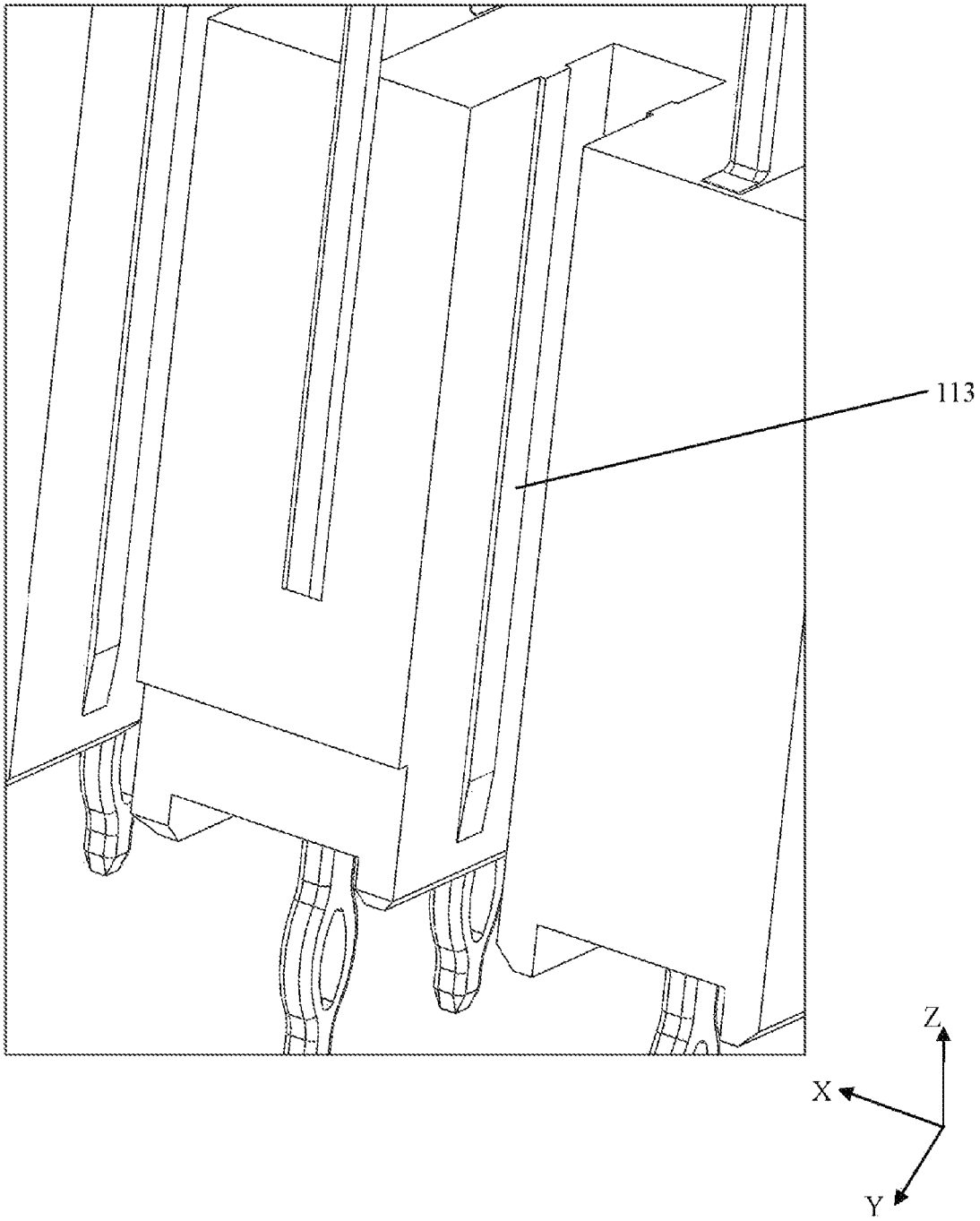

As shown in FIG. 7, FIG. 8*a* and FIG. 8*b*, a protruding rib 113 may be formed on the notch 11*a*, and the protruding rib 113 forms interference fit with the L-shaped protrusion 121 (for conveniently showing the protruding rib 113, the L-shaped protrusion 121 is not shown in FIG. 7, FIG. 8*a* and FIG. 8*b*), so that connection stability of the conductive body 12 and the insulating body 11 is enhanced. Such interference fit may be hard interference, that is, at least one protruding rib 113 is formed on an inner surface of the notch 11*a*, and a corresponding lateral surface of the corresponding L-shaped protrusion 121 is flat, and when the L-shaped protrusion 121 is inserted into the notch 11*a*, the L-shaped protrusion 121 is firmly clamped into the notch 11*a* by the protruding rib 113.

As shown in FIG. 8*a* and FIG. 8*b*, the protruding rib 113 on the notch 11*a* linearly extends along the insertion direction Z, and a thickness of at least part of the protruding rib 113 may gradually decrease from top to bottom along the insertion direction Z to form a guide section, so that, when the conductive body 12 is inserted into the insulating body 11 from below shown in FIG. 8*a*, a part of the protruding rib with a relatively small thickness at the lower portion may conveniently guide the insertion of the L-shaped protrusion 121 and provide a gradually enhanced clamping effect along with increase of an insertion depth thereof. However, the disclosure is not limited thereto. In an alternative solution, a fit manner for the L-shaped protrusion 121 and the notch 11*a* may be concave-convex fit or other equivalent means to achieve the effect of fixing the two.

As shown in FIG. 7, the insulating body 11 includes a plurality of first terminal openings 111 and a plurality of second terminal openings 112, the plurality of grounding terminals 13 pass through the plurality of first terminal openings 111 respectively, and the plurality of signal terminals (including the first signal terminals 14*a* and the second signal terminals 14*b*) pass through the plurality of second terminal openings 112 respectively, wherein the first terminal openings 111 are communicated with the notches 11*a* respectively, so that when the L-shaped protrusions 121 are inserted into the notches 11*a*, the short edge portions 121*a* of the L-shaped protrusions 121 may be electrically connected with the grounding terminals 13.

Figure 5:
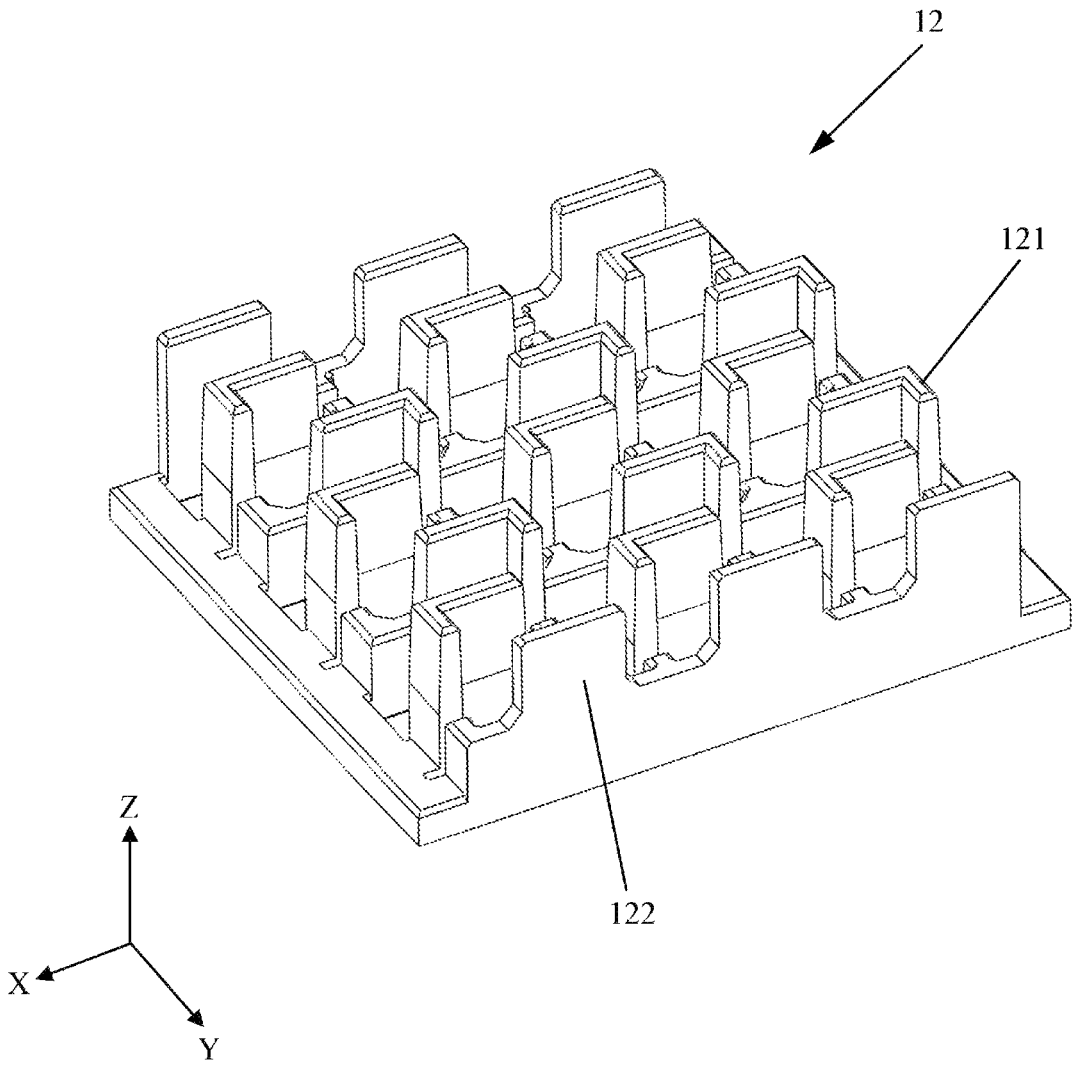
FIG. 5 is a perspective view of the conductive body of the electrical connector according to the first embodiment of the disclosure.
Figure 6:
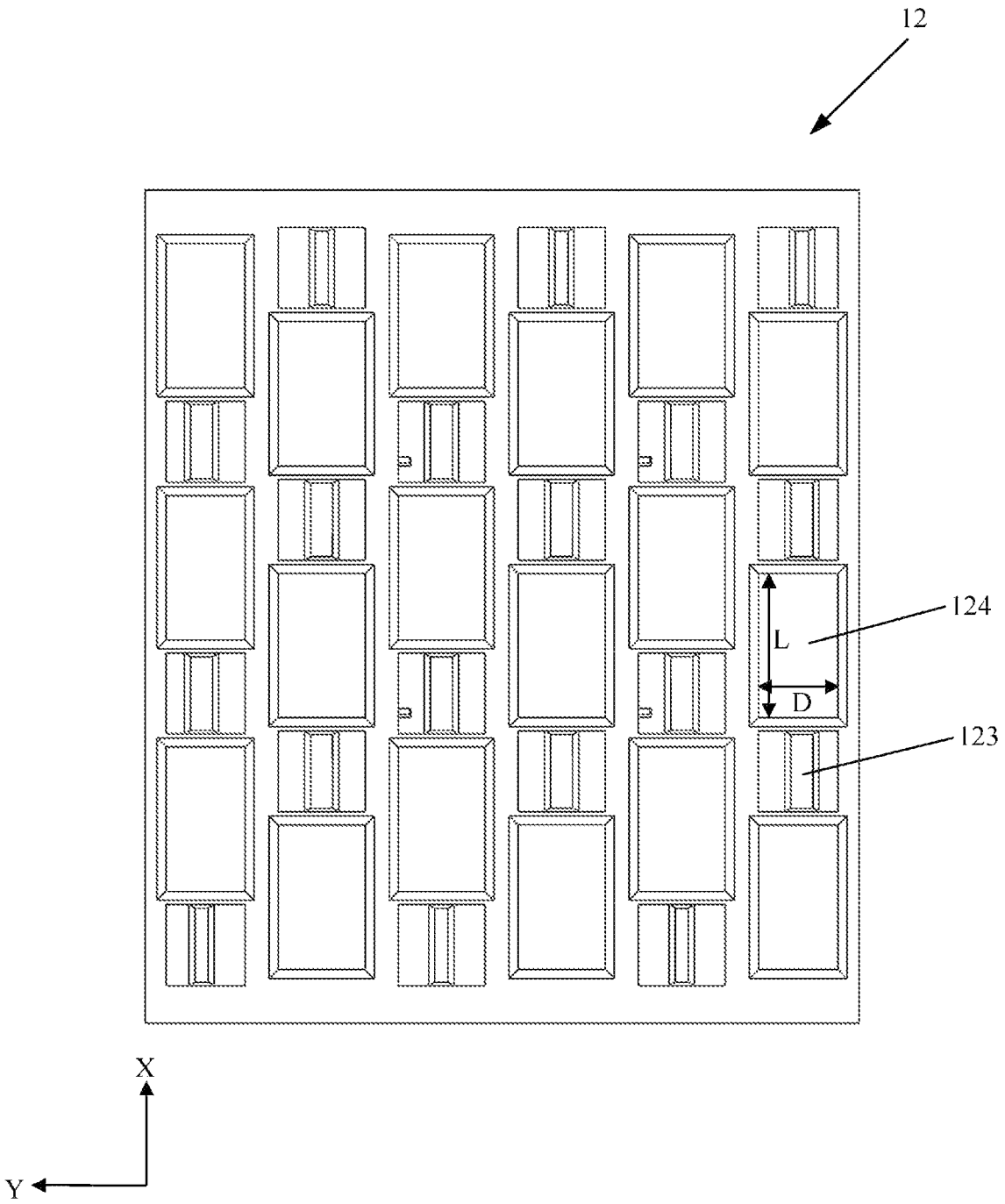
FIG. 6 is a bottom view of the conductive body of the electrical connector according to the first embodiment of the disclosure.

As shown in FIG. 5 and FIG. 6, the conductive body 12 includes a plurality of third terminal openings 123 and a plurality of fourth terminal openings 124, the plurality of grounding terminals 13 pass through the plurality of third terminal openings 123 respectively and are electrically connected with the conductive body 12, and the plurality of differential signal terminal pairs 14 pass through the plurality of fourth terminal openings 124 respectively and are disengaged from the conductive body 12, wherein the fourth terminal opening 124 is a rectangular structure, a length D of a short edge of the rectangular structure is not less than 1.6 mm and a length L of a long edge adjacent to the short edge is not less than 2.7 mm.

Figure 9:
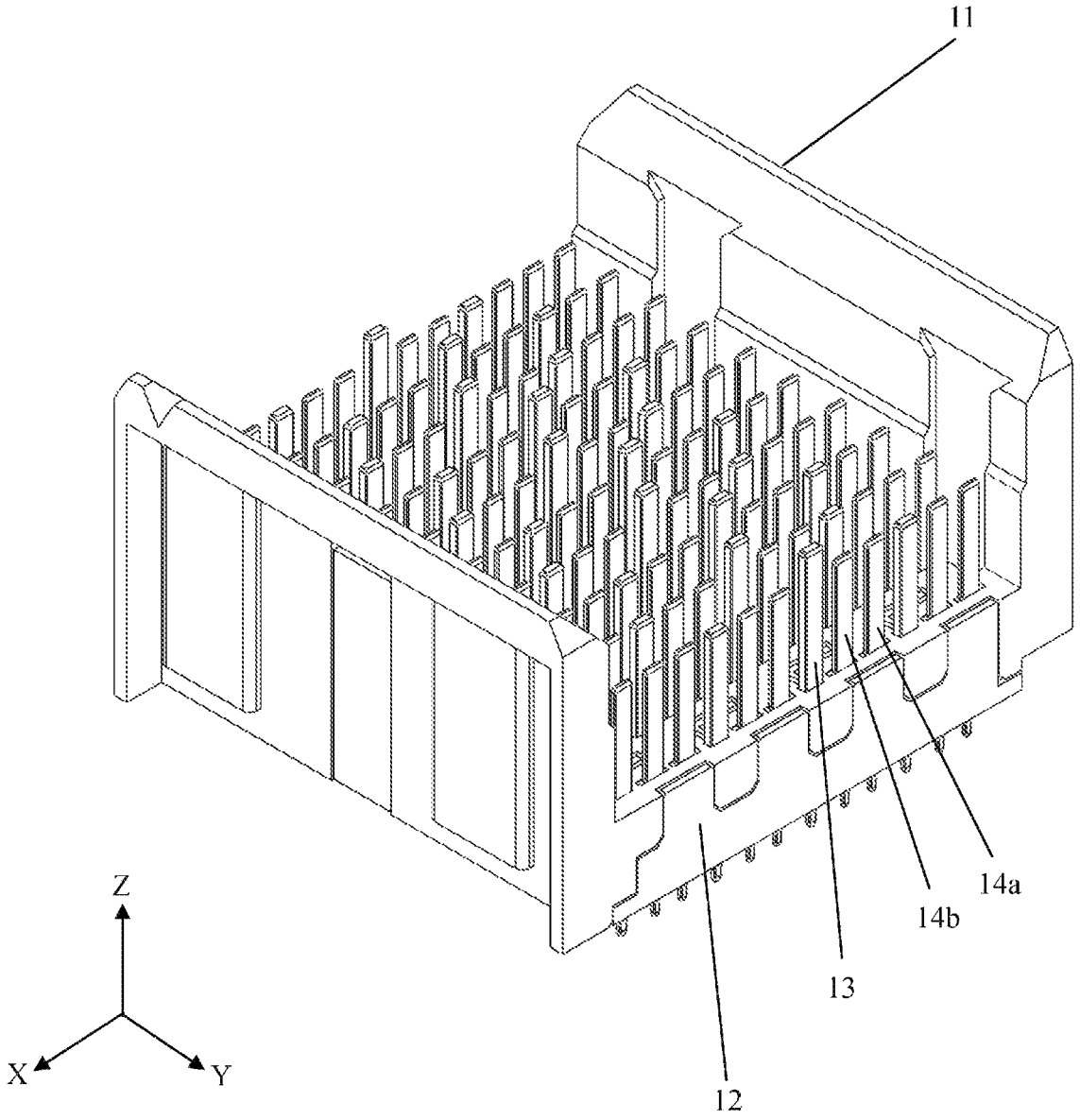
FIG. 9 is a perspective view of an electrical connector according to a second embodiment of the disclosure.

FIG. 9 illustrates an electrical connector according to a second embodiment of the disclosure. An arrangement thereof is substantially same as the arrangement for the first electrical connector shown in FIG. 1 to FIG. 8*b*, one difference therebetween is the electrical connector according to the second embodiment including ten terminal rows and twelve terminal columns and the assembling manner for the conductive body is also different.

Figure 10:
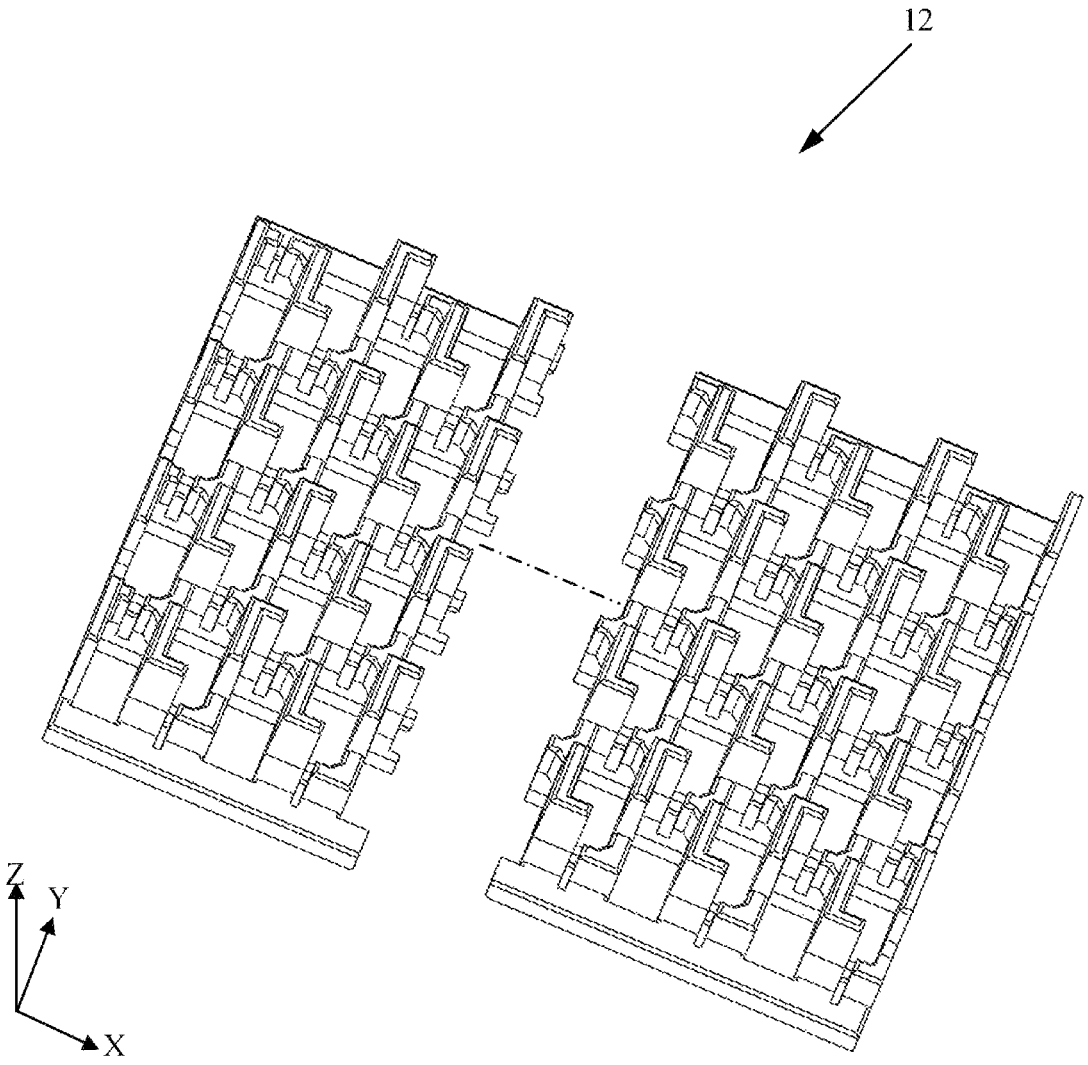
FIG. 10 is a perspective view of a conductive body of the electrical connector according to the second embodiment of the disclosure, wherein the conductive body is a two-piece structure.

As shown in FIG. 10, the conductive body of the electrical connector in each embodiment of the disclosure may be of a split structure, for example, may adopt a two-piece structure shown in FIG. 10, which consists of two half portions electrically connected together. For an electrical connector with a large size due to relatively large numbers of grounding terminals and signal terminals, such two-piece structure (split structure) is convenient to manufacture.

Figure 11:
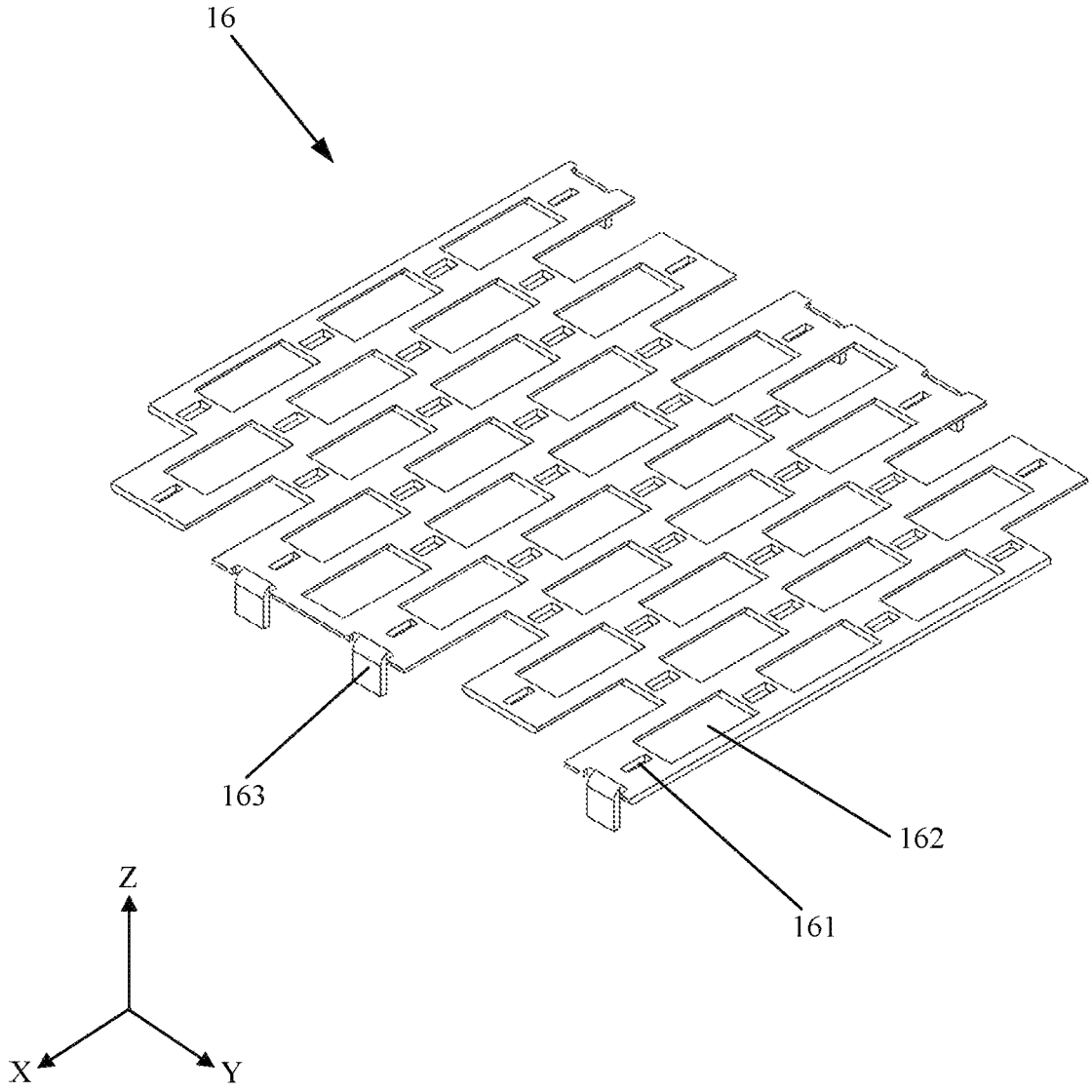
FIG. 11 is a perspective view of a shielding net of an electrical connector according to the disclosure.
Figure 12:
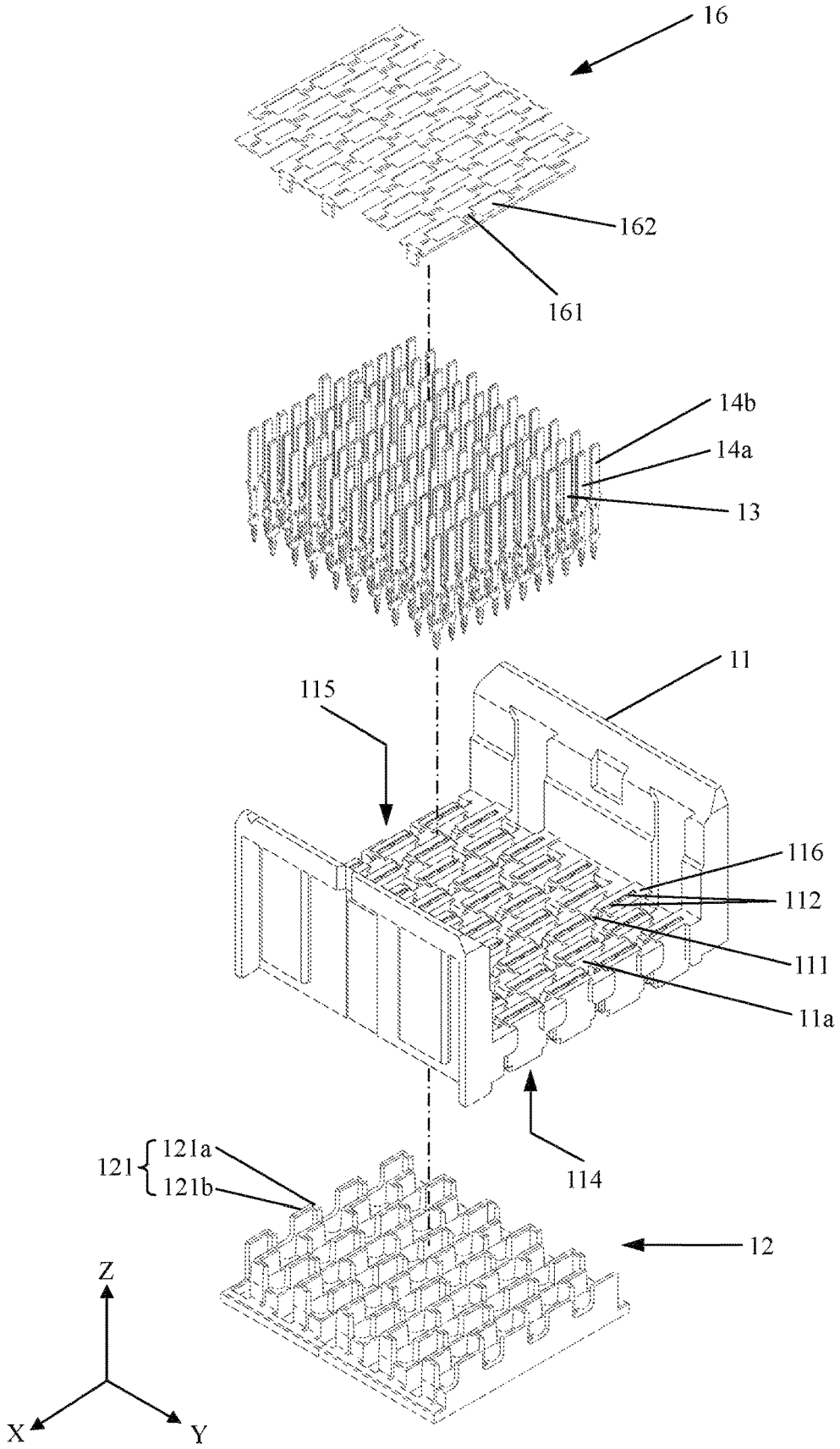
FIG. 12 is an explored view of an electrical connector according to a third embodiment of the disclosure.

As shown in FIG. 11 and FIG. 12, in an electrical connector according to the application (including the first embodiment and the second embodiment), the insulating body 11 includes a first surface 114 and a second surface 115 opposite to the first surface 114; the plurality of grounding terminals 13 and the plurality of signal terminals are connected to the insulating body 11 in an array; and the conductive body 12 is connected to the insulating body 11 from the first surface 114. The electrical connector further includes a shielding net 16, the shielding net 16 is made from a conductive material, and the conductive material may be a metal, conductive plastic . . . etc. The shielding net 16 is connected to the insulating body 11 from the second surface 115 and electrically connected to the conductive body 12, and the plurality of grounding terminals 13 are electrically connected with the shielding net 16 through the conductive body 12, so that shielding in a insertion direction Z may be implemented better by the shielding net 16, and meanwhile, common ground of the grounding terminals 13 may also be ensured. In another embodiment (not shown) of the application, the shielding net may also be formed by injection molding together with the insulating body to be directly embedded into the second surface of the insulating body.

The conductive body 12 and the shielding net 16 may be made from a wave absorbing material, an electrically lossy material or the like, and the electrically lossy material is formed by adding a filler including a conductive particle into a binder. Examples of the conductive particle capable of forming the electrically lossy material as the filler may include a carbon or graphite in a fiber or sheet form, or other particle form. Metal in powder, sheet, fiber or other particle form may also be used for providing a proper electrical loss characteristic. Optionally, a combination of fillers may be used. For example, a metal-plated carbon particle may be used. Silver and nickel are proper plated metals for fibers. A coated particle may be used independently or combined with a filler of another fiber such as a carbon sheet for use.

In some embodiments, a binder may be a thermoplastic material and a high-temperature-resistant nylon material, and is for example routinely used for manufacturing the electrical connector to die-cast the electrically lossy material into an expected shape and position as part of manufacturing of the electrical connector. However, binder materials in many optional forms may be used. A curable material such as an epoxy resin may also be used as the binder. Optionally, a material such as a thermoplastic resin or adhesive may be used. Moreover, although the above-described binder material forms the binder surrounding the conductive particle filler to create the electrically lossy material, the application is not limited thereto. For example, according to another solution for the conductive body and the shielding net, the thermoplastic material or high-temperature-resistant nylon material routinely for manufacturing the electrical connector may also be injection-molded at first and then metal-plated with a conductive material such as copper, nickel, gold and silver, so that the formed conductive body and shielding net may be electrically connected with each other.

During specific implementation, the shielding net 16 may be arranged such that at least one row of the plurality of grounding terminals 13 in a row direction X is electrically connected with the shielding net 16 through the conductive body 12, and/or such that at least one column of the plurality of grounding terminals 13 in a column direction Y is electrically connected with the shielding net 16 through the conductive body 12. Therefore, the shielding net 16 ensure a perfect shielding effect.

Figure 13:
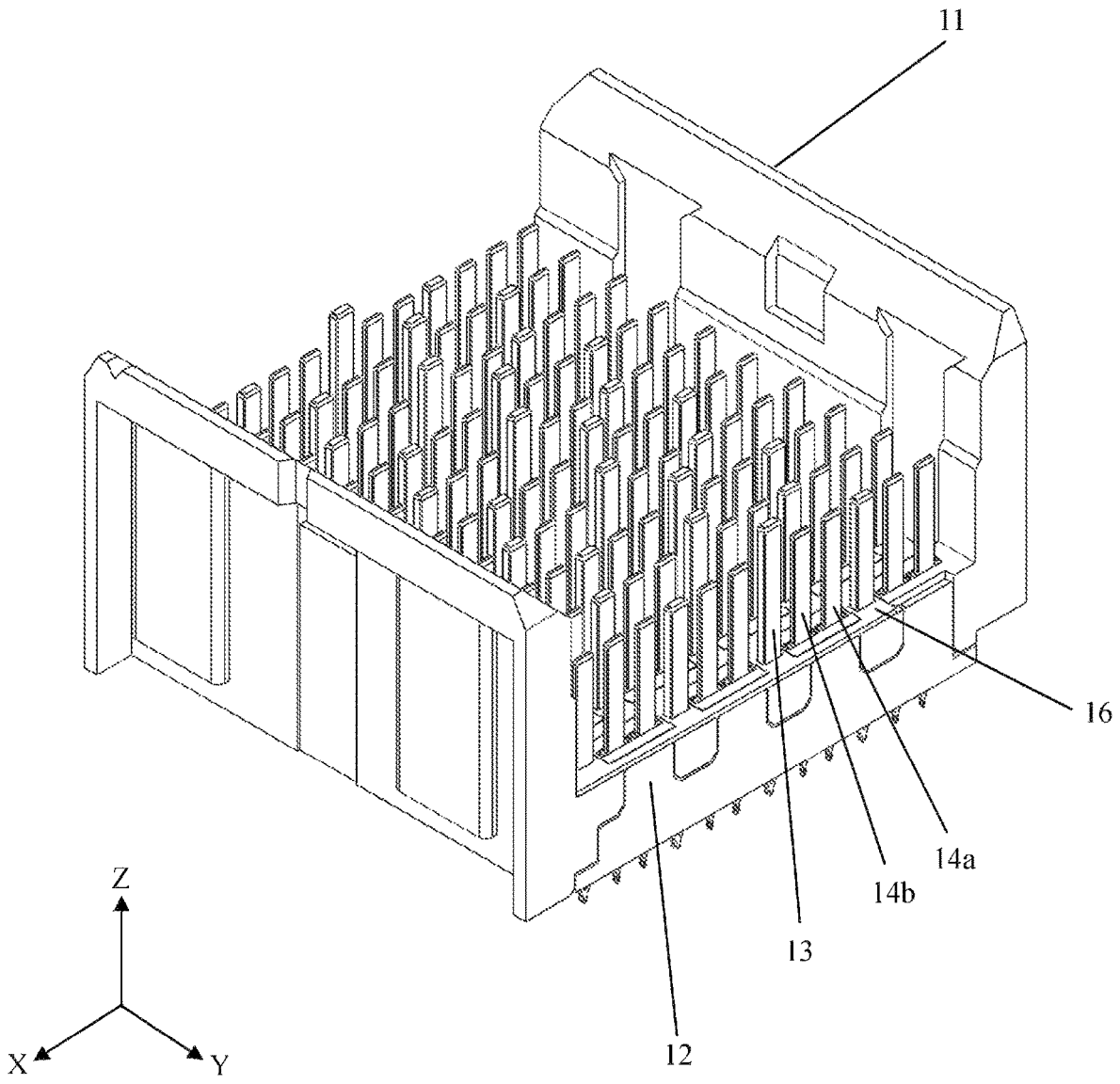
FIG. 13 is a perspective view of the electrical connector according to the third embodiment of the disclosure.

As shown in FIG. 11 to FIG. 13, the shielding net 16 is substantially a rectangular sheet structure, and includes a plurality of terminal opening rows, each terminal opening row includes a plurality of grounding terminal openings 161 for the grounding terminals of the electrical connector to pass through and a plurality of signal terminal openings 162 for the signal terminal pairs of the electrical connector to pass through, the signal terminal opening 162 is configured to space the signal terminal from the shielding net 16, and in any terminal opening row, the grounding terminal openings 161 and signal terminal openings 162 are alternately arranged and separated from each other in the row direction X. Compared with a conventional shielding net, the shielding net 16 of the application distinguishes different openings and keeps a structural completeness and strength of the shielding net 16, so that a shielding area is effectively enlarged.

In addition, from FIGS. 11 and 12, it can also be seen that at least one grounding terminal opening 161 in any terminal opening row of the shielding net 16 and the corresponding grounding terminal opening 161 in another adjacent terminal opening row are staggered in the column direction Y, and projections of at least one signal terminal opening 162 in any terminal opening row and the corresponding signal terminal opening 162 in another adjacent terminal opening row in the column direction Y are at least partially overlapped. By such staggered arrangement, the signal terminals may be isolated better and be arranged more close for increasing the density, thereby performance of the electrical connector may be improved.

One or more connecting tabs 163 formed by downward bending may be arranged at two ends of the shielding net 16 in an extension direction of the terminal opening row respectively, the connecting tabs 163 are used for firmly fixing the shielding net 16 into the second surface 115 of the insulating body 11, and the connecting tabs 163 may be formed integrally with the shielding net 16.

As shown in FIG. 12, a plurality of L-shaped protrusions 121 are arranged on the conductive body 12, wherein a short edge portion 121*a* of the L-shaped protrusion 121 extends along the column direction Y of the array and is electrically connected to the corresponding grounding terminal 13, a long edge portion 121*b* of the L-shaped protrusion 121 extends along the row direction X of the array, and the shielding net 16 directly contacts with a top of the L-shaped protrusion 121 in an insertion direction Z. The L-shaped protrusions 121 are arranged in notches 11*a* of the insulating body 11, and a row of L-shaped protrusions 121 are formed between every two adjacent terminal rows. By such an arrangement, shielding in insertion direction is provided by the shielding net 16 and the conductive body 12, shielding in four lateral directions is provided by the grounding terminals 13 and the L-shaped protrusions 121, so that the effect of complete shielding in six space directions can be achieved.

Besides contacting with the L-shaped protrusions 121 of the conductive body 12, the shielding net 16 may further fit with the grounding terminals 13 in a manner of setting sizes of the grounding terminal openings 161 or by additional spring arms (not shown) or the like, to directly connect with the grounding terminals 13 through the grounding terminal openings 161.

As shown in FIG. 12 and FIG. 13, on the second surface 115 of the insulating body 11, a protruding portion 116 is formed at a portion surrounding the second terminal opening 112. Moreover, when the shielding net 16 is connected to the second surface 115, the shielding net 16 is electrically connected with the L-shaped protrusions 121, and the second terminal openings 162 of the shielding net 16 fit with the protruding portions 116. Preferably, after mounting, the shielding net 16 is arranged on the second surface 115 of the insulating body 11 and forms a relatively flat surface structure together with the protruding portions 116 on the second surface 115. Further, the shielding net 16 and the protruding portions 116 are arranged substantially on the common plane.

In addition, a distance between each differential signal terminal pair 14 and the second terminal opening 162 may be ensured since the arrangement of the protruding portions 116 when each differential signal terminal pair 14 passes through the corresponding one signal terminal opening 162 in the shielding net 16, and by the distance, the signal terminal pair 14 may be prevented from contacting with the shielding net 16, thereby effectively preventing short-circuit and potential crosstalk influence.

The above is only the preferred embodiment of the application and not intended to limit the application. For those skilled in the art, the application may have various modifications and variations. Any modifications, equivalent replacements, improvements and the like made within the spirit and principle of the application shall fall within the scope of protection of the application.

What is claimed is:

1. An electrical connector, comprising:

an insulating body, comprising a first surface and a second surface opposite to the first surface;

a plurality of grounding terminals and a plurality of signal terminals connected to the insulating body in an array respectively;

a conductive body, connected to the insulating body from the first surface; and a shielding net, wherein the shielding net is connected to the insulating body from the second surface and directly electrically connected to the conductive body, and the plurality of grounding terminals are electrically connected with the shielding net through the conductive body, wherein the shielding net comprises a plurality of terminal opening rows, each terminal opening row comprises a plurality of grounding terminal openings for the grounding terminals of the electrical connector to pass through and a plurality of signal terminal openings for the signal terminals to pass through, the signal terminal openings are configured to space the signal terminals from the shielding net, and in any terminal opening row, the grounding terminal openings and signal terminal openings are alternately arranged and spaced from one another in a row direction, and wherein projections of at least one signal terminal opening in any terminal opening row and the corresponding signal terminal opening in another adjacent terminal opening row in a column direction are at least partially overlapped.

2. The electrical connector as claimed in claim 1, wherein at least one row of the plurality of grounding terminals in a row direction is electrically connected with the shielding net through the conductive body.

3. The electrical connector as claimed in claim 1, wherein at least one column of the plurality of grounding terminals in a column direction is electrically connected with the shielding net through the conductive body.

4. The electrical connector as claimed in claim 1, wherein at least one grounding terminal opening in any terminal opening row and the corresponding grounding terminal opening in another adjacent terminal opening row are staggered in a column direction.

5. The electrical connector as claimed in claim 1, wherein one or more connecting tabs formed by downward bending are arranged at two ends of the shielding net in an extension direction of the terminal opening row respectively.

6. The electrical connector as claimed in claim 1, wherein a plurality of L-shaped protrusions are arranged on the conductive body, wherein a short edge portion of the L-shaped protrusion extends along a column direction of the array and is electrically connected to the corresponding grounding terminal, a long edge portion of the L-shaped protrusion extends along a row direction of the array, and the shielding net directly contacts with a top of the L-shaped protrusion in an insertion direction.

7. The electrical connector as claimed in claim 6, wherein the L-shaped protrusions are arranged in notches of the insulating body respectively, and a row of the L-shaped protrusions are formed between every two adjacent terminal rows.

8. The electrical connector as claimed in claim 1, wherein a protruding portion is formed on the second surface of the insulating body for fitting with the shielding net.

9. The electrical connector as claimed in claim 8, wherein the shielding net comprises a plurality of signal terminal openings for the signal terminals to pass through, each of the signal terminal openings fits with the protruding portion.

10. The electrical connector as claimed in claim 8, wherein the shielding net is arranged on the second surface of the insulating body and forms a substantially flat surface with the protruding portion.

11. The electrical connector as claimed in claim 8, wherein the insulating body comprises a plurality of first terminal openings for the grounding terminals to pass through and a plurality of second terminal openings for the signal terminals to pass through, the protruding portion is formed at a portion surrounding the second terminal opening.

12. The electrical connector as claimed in claim 9, wherein every two adjacent signal terminals in a row direction of the array form a differential signal terminal pair, and each differential signal terminal pair passes through the corresponding signal terminal opening of the shielding net and is at a distance from the signal terminal opening.

13. The electrical connector as claimed in claim 1, wherein the shielding net is a metal shielding net.

14. The electrical connector as claimed in claim 1, wherein the shielding net is a conductive plastic shielding net.

* * * * *